United States Patent [19]

Shioiri et al.

[11] Patent Number: 4,657,775

[45] Date of Patent: Apr. 14, 1987

[54] METHOD FOR PRODUCTION OF SILICON THIN FILM PIEZORESISTIVE DEVICES

[75] Inventors: Hisanori Shioiri; Mitsuhiro Kiuchi; Mineo Takayama; Toshio Homma; Hiroshi Nagasaka, all of Ueda; Yoshikazu Kaneko, Togura, all of Japan

[73] Assignee: Kabushiki Kaisha Nagano Keiki Seisakusho, Tokyo, Japan

[21] Appl. No.: 815,305

[22] Filed: Dec. 30, 1985

Related U.S. Application Data

[63] Continuation of Ser. No. 681,105, Dec. 12, 1984, abandoned.

[30] Foreign Application Priority Data

Sep. 13, 1984 [JP] Japan ..... 59-192336

[51] Int. Cl.[4] ..... B05D 3/06

[52] U.S. Cl. ..... 427/38; 427/100

[58] Field of Search ..... 427/38, 100

[56] References Cited

U.S. PATENT DOCUMENTS 4,504,518 3/1985 Ovsitinsky et al. ..... 427/38

OTHER PUBLICATIONS

Matsumura et al., Appl. Phys. Lett., vol. 36, No. 6, Mar. 15, 1980, "A Heat-Resisting New Amorphous Silicon", pp. 439–440.

Tong et al., Appl. Phys. Lett., vol. 38, No. 10, May 15, 1981, "Highly Stable, Photosensitive Evaporated Amorphous Silicon Films", pp. 789–790.

*Primary Examiner*—Bernard D. Pianalto

*Attorney, Agent, or Firm*—Parkhurst & Oliff

[57] ABSTRACT

Semiconductor piezoresistive devices can be obtained by the plasma CVD method, i.e., exposing a substrate to a plasma atmosphere produced from silicon hydride gas containing boron hydride to deposit on the substrate a thin film of crystalline silicon as a piezoresistive material. In accordance with this method, it is possible to form piezoresistive devices into IC's and also to impart excellent properties thereto.

4 Claims, 7 Drawing Figures

METHOD FOR PRODUCTION OF SILICON THIN FILM PIEZORESISTIVE DEVICES

This is a continuation of application Ser. No. 681,105 filed Dec. 12, 1984, abandoned.

BACKGROUND OF THE INVENTION

1. Technical Field

The present invention relates generally to semiconductor piezoresistive devices. More particularly, the invention relates to a method for production of semiconductor piezoresistive devices wherein a thin film of crystalline silicon is formed on a substrate substantially in accordance with the plasma chemical vapor deposition (plasma CVD) method.

2. Background Art

A variety of methods for production of semiconductor piezoresistive devices have been proposed so far. For example, these devices can be obtained by cutting a single crystal into rectangles or from a thin film formed by the physical vapor deposition (PVD) method such as vacuum deposition. The piezoresistive device thus obtained is stuck, adhesive-bonded or vacuum-evaporated as a pressure sensitive member onto a strain-receiving member (e.g., metal sheet, bellows or metal diaphragm) and the like, and variations in the specific resistance (piezoresistance effect) of the device due to variations in the strain of the strained member is utilized. The device is applied to pressure sensors and the like.

In another method, the semiconductor piezoresistive devices can be produced by forming in a single crystal substrate a diffusion layer different in type from the substrate. In the case of the single crystal substrate thus produced, the semiconductor substrate acts per se as a slrain-receiving member, and the diffusion layer in the semiconductor forms a piezoresistive device.

The former two methods which involve cutting a single crystal and vacuum evaporation respectively can provide piezoresistive devices having the advantageous features of low temperature coefficients with respect to the resistivity and gauge factor coupled with a wide temperature range in which the devices are operable, but cannot be employed to form such devices into IC's having an active function.

The latter diffusion method, on the other hand, can ensure mass production of piezoresistive devices and formation of IC's therefrom. In the piezoresistive device obtained by this method, however, a saturation current which is dependent on temperature flows into the p-n junction, where the substrate and the device are separated from each other (reversely biased), whereby the temperature range in which the device is operable is limited. Further, the piezoresistive device produced by the diffusion method has high temperature coefficients with respect to both the resistivity and the gauge factor, i.e., 2000 ppm/°C. and −1000 ppm/°C., respectively. For this reason, temperature compensation by either active devices such as transistors formed discretely or simultaneously or thermo-sensitive resistors is required. This results in reduced reliability and lowered responsiveness due to complicated process steps and hence an increased number of devices

SUMMARY OF THE INVENTION

An object of the present invention is to overcome the difficulties accompanying the above described methods and to provide a method for production of piezoresistive devices which have excellent properties such as a wide operable temperature range and can be formed into IC's.

Among the thin film forming techniques applied in the production of IC's, LSI's and the like is the plasma CVD method. In this method, for example, a high-frequency electric field is applied to a reactant gas to activate the gas by the electric energy thereof, and the gaseous substance reacts in the plasma to deposit a thin film over the surface of a substrate at a relatively low temperature (c.f. Takuo Sugano (ed.), "Handōtai Plasma Process Gijutsu (The Semiconductor Plasma Process Technology)", Sangyo Tosho, Tokyo, (July 10, 1980), pp. 50–60: M. Millard in "Techniques and Applications of Plasma Chemistry", edited by J. R. Hollahan and A. T. Bell (Wiley-Interscience, New York, 1974)).

In one application of the plasma CVD method, a thin film of amorphous silicon was obtained from silicon hydride at a temperature as low as about 300° C. This silicon thin film is being commercially produced as a material for solar cells but is unsuitable for piezoresistive devices because the film is amorphous and has poor heat resistance, and hence is not sufficiently reliable.

Unexpectedly, however, we have found that crystalline silicon thin film piezoresistive devices possessing excellent properties can be obtained by introducing boron hydride into the silicon hydride gas and further modifying the reaction conditions. On the basis of this finding, we have arrived at the present invention.

Thus, the method for production of thin silicon film piezoresistive devices according to the present invention is characterized in that the substrate is exposed to a plasma atmosphere produced from silicon hydride gas containing boron hydride to deposit thereon a thin film of crystalline silicon as a piezoresistive material.

In a preferred embodiment of the present invention, the temperature of the substrate during the deposition treatment can be at least 450° C.

In another embodiment of this invention, the substrate can be formed with an electrically insulating material.

In still another embodiment of the invention, the mole ratio between the silicon hydride and the boron hydride used in the preparation of plasma can be 100:0.01 to 100:2.

In a further embodiment of the invention, the crystal surface (220) of the thin crystalline silicon film can be oriented substantially perpendicular to the surface of the substrate.

Although not intended to limit the scope of the invention, boron introduced into the silicon hydride gas in accordance with the present invention is considered to act as a catalyst for improving the crystallinity of the thin silicon film and as impurities that maintain appropriate electroconductivity and temperature characteristics of the piezoresistive device. In any case, the present invention affords the following advantages.

(a) The crystallinity of the thin silicon film can be improved by virtue of the catalysis and impurity activity of boron, whereby the mobility ($\mu$) of the film increases, while better electroconductivity and temperature characteristics such as an operable temperature range can be obtained. Accordingly, the silicon thin film of the piezoresistive device produced by the method of the present invention under the optimum conditions has a predominant orientation and also exhibits a remarkable piezoresistance effect.

(b) Since the plasma CVD method is applied in the present invention, the piezoresistive device obtained can be formed into an IC, and therefore can be utilized not only in a pressure sensor but also in, for example, a TFT in IC form.

DESCRIPTION OF THE PREFERRED EMBODIMENTS

In the present invention, the thin silicon film is formed substantially in accordance with the plasma CVD method, i.e., by utilizing thermal decomposition due to plasma enhancement. The parameters of the plasma CVD method (for example, the atmospheric temperature, composition and concentration of the gases used, temperature of the substrate, pressure, flow rate, configuration of the reactor, reaction time, and cleanliness of the reaction system) can be suitably varied depending upon the desired properties, uses and configuration of the product piezoresistive device.

The reactant gases used in this invention to induce plasma include silicon hydride gas and boron hydride gas. These reactant gases are introduced into a reactor as a mixture or separately. The compositional ratio between the silicon hydride and the boron hydride can be suitably varied with the properties and the like of the film to be formed. For example, these gases are used with a mole ratio of from 100:0.01 to 100:2, preferably from 100:0.1 to 100:0.8. As a carrier gas for the reactant gases, $H_2$, Ar or He, for example can be employed.

The chemical species in the plasma vary according to the method of generating the plasma, the pressure of the gases, and some other conditions. Examples of such species may be ions, electrons, neutral molecules and atoms. The term "plasma" as used herein is intended to mean reactant gases activated by the electric energy of, for example, a high-frequency electric field applied thereto.

The plasma CVD apparatus that can be used in the practice of the method of this invention may be of the inductance coupling system and of the capacity coupling system. (For particulars of the plasma apparatus, reference is made to pages 101 to 204 of the aforementioned "Handotai Plasma Process Gijutsu (The Semiconductor Plasma Process Technology)" which is incorporated herein by reference. cf. M. Millard, "Techniques and Applications of Plasma Chemistry", edited by J. R. Hollahan and A. T. Bell, Wiley-Interscience, New York (1974)).

The temperature of the substrate during the deposition treatment can be varied depending upon the desired properties of the piezoresistive device. For instance, temperatures of 400° C. or higher can be employed, 450° C. or higher being preferred, 480° C. or higher being more preferred, 500° to 650° C. being most preferred. Those silicon films obtained at lower temperatures do not have good crystallinity. On the other hand, the thermal impairment of the thin films obtained at higher temperatures will increase.

While the material, configuration, size, and electrical characteristics of the substrate used in the present invention can be suitably altered according to the desired properties, uses and configuration of the piezoresistive device, it is preferable that the substrate be formed with an electrically insulating material such as metal oxides (e.g., $SiO_2$) or coated with an insulator.

Figure 1A:
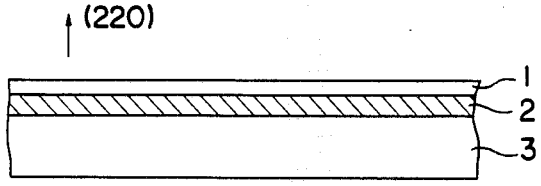
FIG. 1*a* is a fragmentary, enlarged sectional view of a substrate on which a silicon thin film is deposited.
Figure 1B:
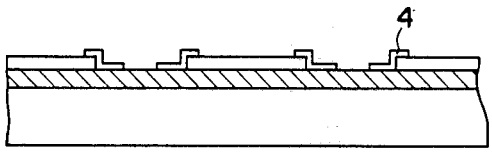
FIG. 1*b* is a similar sectional view of a piezoresistive device obtained by etching the silicon thin film shown in FIG. 1*a;*

The substrate on which a thin silicon film is deposited in accordance with the present invention comprises an insulation layer 2 of $SiO_2$, on which a thin silicon film 1 is laminated as is shown, for example, in FIG. 1*a*. Underneath the insulation layer 2 is provided a metal sheet 3 as a support. After the deposition, the assembly of the substrate 2 and the thin film is formed into a piezoresistive device by a conventional method. FIG. 1*b* shows an example of a piezoresistive device obtained by etching the thin film on the substrate as is shown in FIG. 1*a* according to a specific pattern and connecting electrodes to vaporization wiring 4 thereof.

In order to indicate more fully the nature and utility of this invention, the following specific example of practice is set forth, it being understood that the example is presented as illustrative only and is not intended to limit the scope of the invention.

EXAMPLE

Reactant gases introduced into a reactor were activated in a plasma CVD apparatus of the inductance coupling system to deposit a silicon thin film on an insulated substrate.

A reaction tube comprising a quartz tube (outer diameter: 42 mm) and an induction coil winding therearound was evacuated with a vacuum pump through one end of the tube. The substrate was placed on a table within the reaction tube. The substrate which was used in this example comprised a layer of $SiO_2$ formed on a metal sheet.

$SiH_4$ gas (90% diluted with $H_2$) and $B_2H_6$ gas (1,500 ppm, diluted with $H_2$) were introduced into the reaction tube in a ratio of 100:0.76 between $SiH_4$ and $B_2H_6$ through the other end thereof. The flow rates of the $SiH_4$ and $B_2H_6$ were finely adjusted with needle valves to 59 SCCM ($cm^3$/min. at 1 atm. at 20° C.) and 30 SCCM, respectively. The pressure within the reaction tube was set at about 2.6 Torr. This degree of vacuum was measured by a Pirani gauge provided on the evacuation side. The R.F. power was 30 W, and the temperature of the substrate (Ts) was 450° C. The deposition treatment was carried out for 15 minutes to produce the desired piezoresistive device.

Subsequently, piezoresistive devices were produced similarly as in the above described example except that the temperature of the substrate (Ts) was varied to 500° C., 550° C., 575° C., 600° C., 625° C. and 650° C.

Figure 2A:
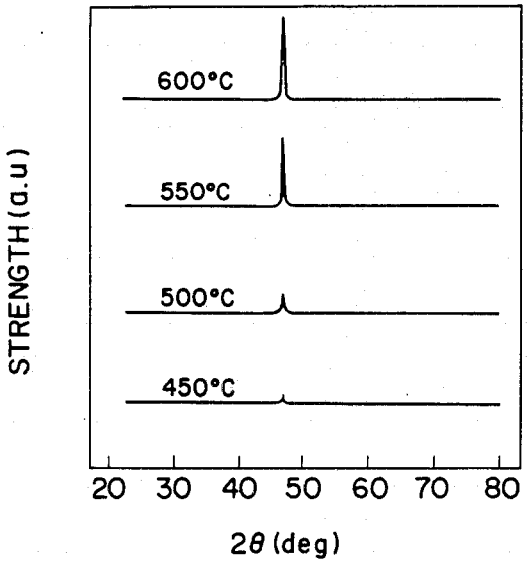
FIG. 2*a* is a graph showing an X-ray diffraction of the thin silicon film according to the present invention.

The X-ray diffraction of each of the devices thus obtained was analyzed, whereupon the results shown in FIG. 2*a* were obtained. Further, the rate of variation of resistance ($\Delta R/R$) relative to strain of each of the devices was measured, whereupon the results set forth in FIG. 3 were obtained. The rate of variation of gauge factor relative to the ambient temperature and the ambient temperature dependency of the resistance of each device were also measured. The results are indicated in FIG. 4*a* and FIG. 4*b*.

For comparison purposes, silicon thin films were formed by using reaction gases not containing any boron hydride. The X-ray diffraction of each of the substrates obtained was analyzed. The results are shown in FIG. 2*b*.

As is observable from the X-ray diffraction spectra shown in FIG. 2*a*, the thin silicon films according to the present invention have high crystallinity and tend to be oriented toward (220) when the temperature of the substrate (Ts) exceeds 500° C. The piezoresistive device of this invention has a high gauge factor on the predominant orientation surface (220) so that a pressure sensor in which the device is employed can exhibit a great change in resistance when the surface is subjected to a strain.

Figure 2B:
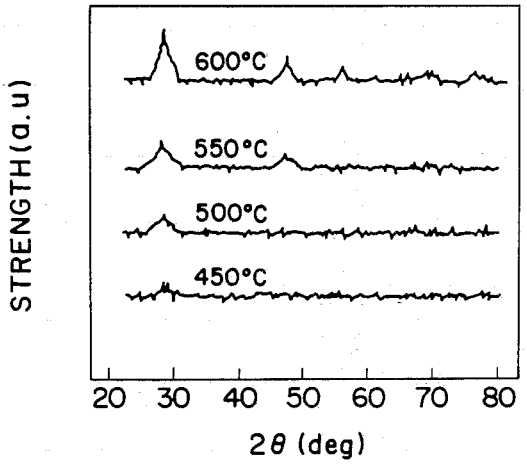
FIG. 2*b* is a graph showing an X-ray diffraction of a silicon thin film obtained by using a reactant gas containing no boron hydride.

As will be apparent from the comparison between FIG. 2*a* and FIG. 2*b*, the device obtained without the use of boron hydride does not show the tendency toward orientation as in the device of the present invention but simply has a tendency toward multicrystallization.

Figure 3:
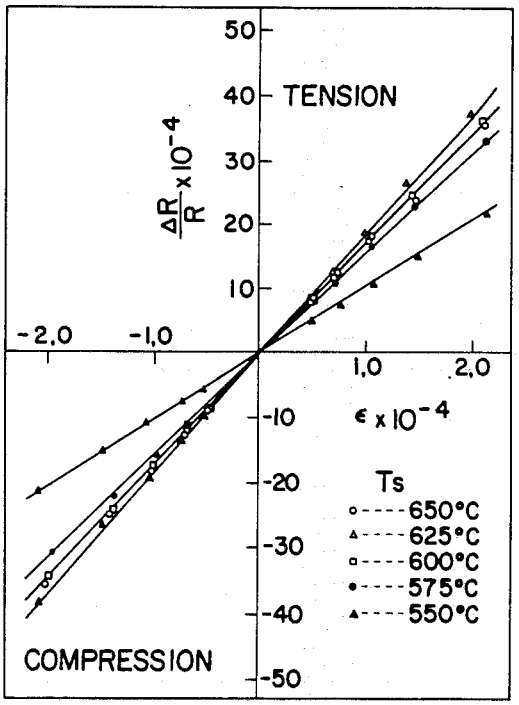
FIG. 3 is a graph indicating the strain-resistance characteristics of a piezoresistive device according to the present invention.
Figure 4A:
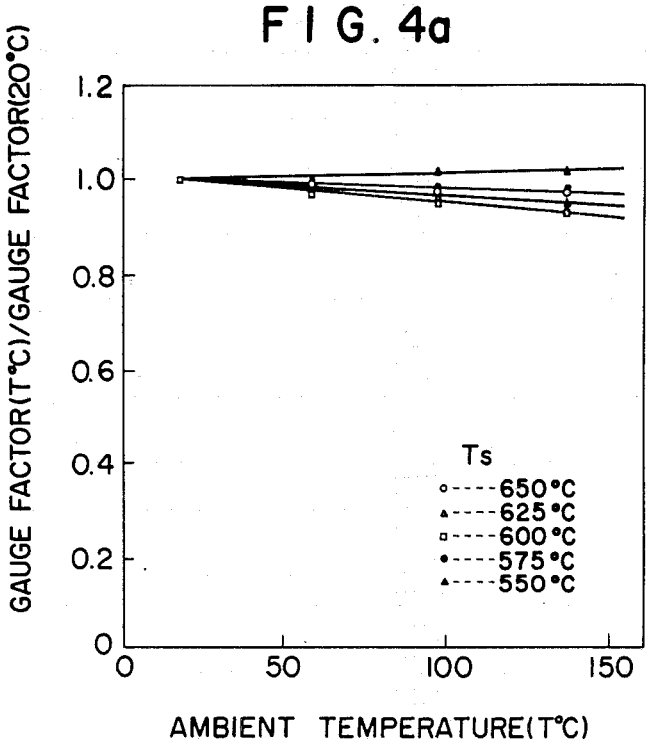
FIGS. 4*a* and 4*b* are graphs respectively indicating the temperature characteristics of the gauge factor and resistivity of a piezoresistive device according to the present invention.
Figure 4B:
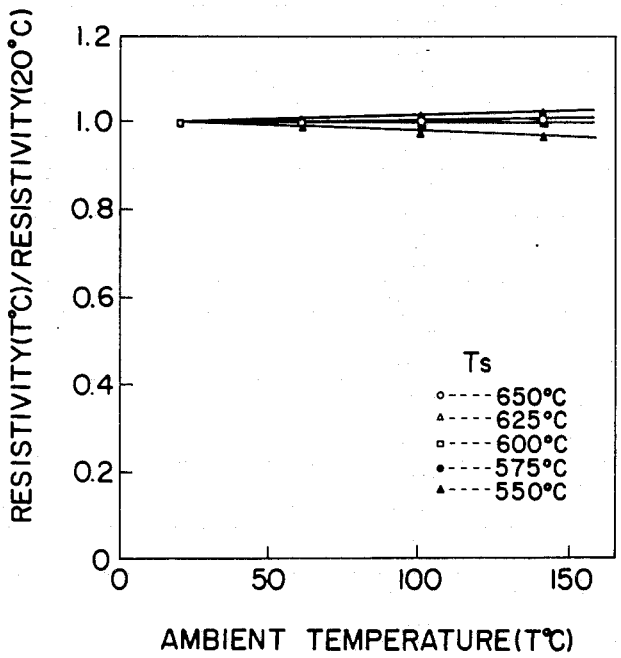

FIG. 3 indicates rates of variation of resistance with respect to strain. These silicon thin films have p-type conductivity because of the addition of boron, and the rate of variation of resistance ($\Delta R/R$) increases with tension while decreasing with compression. As is apparent from FIG. 3, the piezoresistive device of the present invention has linearity with respect to strain.

FIG. 4*a* indicates rates of variation of gauge factor with respect to ambient temperature. According to this graph, the silicon thin film formed on the substrate at a temperature of about 500° C. exhibits positive ambient temperature dependency, and the film formed on the substrate at a temperature higher than about 575° C. exhibits negative ambient temperature dependency.

FIG. 4*b* indicates the ambient temperature dependency of the resistance of the piezoresistive devices. It will be noted from this FIGURE that the temperature dependency becomes negative, positive or zero according to the temperature of the substrate and the addition of impurities.

As is apparent from the results set forth in FIG. 4*a* and FIG. 4*b*, the piezoresistive device of the present invention has temperature coefficients lower than ±200 ppm/°C. with respect to the resistivity and gauge factor while devices produced by the conventional diffusion method have temperature coefficients of 1000 to 2000 ppm/°C. Thus, the instant piezoresistive device has one figure lower temperature coefficients than the prior art devices, and therefore can be used in a wider temperature range.

What is claimed is:

1. A method for producing silicon thin film piezoresistive devices comprising:

exposing a substrate to a plasma atmosphere produced from silicon hydride gas containing boron hydride, and depositing on the substrate, at a substrate temperature of between 500° C. and 650° C., a thin film of crystalline silicon as a piezoresistive material.

2. The method of claim 1, wherein a crystal surface (220) of the thin film of crystalline silicon is oriented substantially perpendicular to the surface of the substrate.

3. The method of claim 1, wherein the substrate is electrically insulated.

4. The method of claim 1, wherein a mole ratio between the silicon hydride and the boron hydride used for producing the plasma is from 100:0.01 to 100:2.

* * * * *